US008563203B2

(12) United States Patent
Nishimura et al.

(10) Patent No.: US 8,563,203 B2
(45) Date of Patent: Oct. 22, 2013

(54) ELECTROPHOTOGRAPHIC PHOTOSENSITIVE MEMBER AND ELECTROPHOTOGRAPHIC APPARATUS

(75) Inventors: Yuu Nishimura, Suntou-gun (JP); Hironori Owaki, Susono (JP); Daisuke Tazawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 202 days.

(21) Appl. No.: 13/165,022

(22) Filed: Jun. 21, 2011

(65) Prior Publication Data

US 2011/0318678 A1 Dec. 29, 2011

(30) Foreign Application Priority Data

Jun. 28, 2010 (JP) ..... 2010-146813
Jun. 16, 2011 (JP) ..... 2011-134187

(51) Int. Cl.
*G03G 5/00* (2006.01)

(52) U.S. Cl.
USPC ..... 430/56; 430/84; 399/159

(58) Field of Classification Search
USPC ..... 430/56, 84; 399/159
See application file for complete search history.

(56) References Cited

U.S. PATENT DOCUMENTS 5,582,945 A * 12/1996 Shirai et al. ..... 430/57.7
6,110,629 A 8/2000 Ehara et al.
6,122,467 A 9/2000 Ehara et al.
6,233,417 B1 5/2001 Nakayama et al.
6,605,405 B2 8/2003 Owaki et al.
7,033,717 B2 4/2006 Kojima et al.
7,157,197 B2 1/2007 Aoki et al.
7,255,969 B2 8/2007 Kojima et al.
2010/0021835 A1 1/2010 Akiyama et al.
2010/0021836 A1 1/2010 Ozawa et al.
2010/0021837 A1 1/2010 Ozawa et al.
2011/0117484 A1 5/2011 Ozawa et al.
2011/0123215 A1 5/2011 Nishimura et al.
2011/0123914 A1 5/2011 Akiyama et al.
2011/0123915 A1 5/2011 Ozawa et al.
2011/0129770 A1 6/2011 Aoki et al.
2011/0129776 A1 6/2011 Akiyama et al.
2011/0318678 A1 12/2011 Nishimura et al.

FOREIGN PATENT DOCUMENTS

JP 2004-354967 A 12/2004
JP 2007-179025 A 7/2007

* cited by examiner

*Primary Examiner* — Mark A Chapman
(74) *Attorney, Agent, or Firm* — Fitzpatrick, Cella, Harper & Scinto

(57) ABSTRACT

An electrophotographic photosensitive member is configured such that the average value Hx_ave of the content of hydrogen atoms in a central portion area of a photoconductive layer in a cylindrically axial direction thereof, the content Hx of the hydrogen atoms at an arbitrary point in the central portion area, the average value Hy_ave of the content of the hydrogen atoms in an end area of the photoconductive layer in the cylindrically axial direction thereof, and the content Hy of the hydrogen atoms at an arbitrary point in the end area satisfy $10 \leq Hx_ave \leq 30$, $Hx < Hy$, $|Hx_ave - Hx| \leq 5$, and $2 \leq Hy_ave - Hx_ave \leq 12$.

3 Claims, 4 Drawing Sheets

ELECTROPHOTOGRAPHIC PHOTOSENSITIVE MEMBER AND ELECTROPHOTOGRAPHIC APPARATUS

BACKGROUND OF THE INVENTION

1. Field of the Invention

The present invention relates to an electrophotographic photosensitive member and an electrophotographic apparatus.

2. Description of the Related Art

An electrophotographic apparatus includes an electrophotographic photosensitive member with a surface on which a latent image (electrostatic latent image) and a toner image are formed. The electrophotographic photosensitive member needs to offer high-quality and stable electrophotographic characteristics (the electrophotographic characteristics include potential characteristics, such as charging ability, sensitivity (photosensitivity) and residual potential, and image characteristics, such as resolution and gradation) and durability (wear resistance, printing durability, environment resistance and chemical resistance). An electrophotographic photosensitive member commonly used includes a cylindrical substrate (hereinafter simply referred to as a "substrate") and a photoconductive layer formed on the substrate. A common substrate is formed of metal (alloy) such as aluminum.

A photoconductive material forming the photoconductive layer needs to offer a high sensitivity, a high SN ratio (photo current (Ip)/dark current (Id)), an absorption spectrum compatible with the spectral characteristics of electromagnetic waves (imagewise exposure light) to which the electrophotographic photosensitive member is exposed, high optical responsivity, and a desired dark resistance value.

A photoconductive material that is excellent in these properties is amorphous silicon containing hydrogen atoms (an amorphous material containing silicon atoms as a base and hydrogen atoms). Such amorphous silicon has been put to practical use as a material forming the photoconductive layer of the electrophotographic photosensitive member. The amorphous silicon containing hydrogen atoms is hereinafter also referred to as "a-Si".

A photoconductive layer made of a-Si (hereinafter referred to as an "a-Si photoconductive layer" or simply a "photoconductive layer") is generally formed on a substrate heated to 50 to 400° C., by one of a vacuum deposition method, a sputtering method, a thermal CVD method, a photo CVD method, and a plasma CVD method. Among these film formation methods, the plasma CVD method is suitably used, in which a material gas (material substance) is decomposed by high-frequency or microwave glow discharge to form a-Si deposited film on the substrate. Moreover, a surface layer provided with durability against wear and a usage environment involving temperature and humidity is formed on the a-Si photoconductive layer formed as described above. As a result, an electrophotographic photosensitive member suitable for practical use is manufactured.

A significantly increasing number of recent electrophotographic apparatuses can provide color images (full-color images). This has led to the need to allow the electrophotographic photosensitive member to be mounted in full-color electrophotographic apparatuses. An electrophotographic apparatus configured to output color images frequently outputs not only text documents but also photographs, pictures and design pictures. Hence, there has been a stronger demand to improve resolution and suppress image density non-uniformity and image defects than in the case of black and white electrophotographic apparatuses.

In particular, a demand to suppress image density non-uniformity has been stronger year by year. For example, in a halftone area corresponding to a blue sky portion of a landscape photograph, even slight density non-uniformity is very noticeable. Thus, there has been a greater need to suppress image density non-uniformity than before.

However, when an a-Si photoconductive layer is formed by any of the above-described common film formation methods, the substrate needs to be heated to 50 to 400° C. as described above. When an a-Si photoconductive layer is thus formed on the substrate, the ends of the substrate may be deformed to cause end deformation of the electrophotographic photosensitive member.

A major factor causing such deformation of the ends of the electrophotographic photosensitive member is expected to be a difference in the coefficient of thermal expansion between the substrate and the a-Si photoconductive layer. That is, if the substrate and the a-Si photoconductive layer are cooled after the a-Si photoconductive layer is formed on the substrate, different amounts of heat shrinkage are expected to occur in the substrate and the a-Si photoconductive layer owing to the difference in the coefficient of thermal expansion. As a result, stress acts between the substrate and the a-Si photoconductive layer. Such stress is generally higher at the ends of the substrate, which generally involve the largest amount of heat shrinkage. Hence, the ends of the substrate are deformed to cause the end deformation of the electrophotographic photosensitive member. If the ends of the substrate are unlikely to be deformed, internal stress occurs in the a-Si deposited film of the photoconductive layer. Then, the film (a-Si photoconductive layer) may be peeled off at the ends of the photoconductive layer.

The end deformation of the substrate causes the ends of the electrophotographic photosensitive member to be deformed. This reduces the level of the dimensional accuracy of the electrophotographic photosensitive member. Thus, for example, in a system adopting a contact development scheme, a surface layer of the photoconductive layer is likely to be worn away in a portion where the electrophotographic photosensitive member contacts a developing member. This reduces development uniformity (causes development non-uniformity), leading to image density non-uniformity. Furthermore, for example, in a system adopting a non-contact charging scheme such as a corona charger, the level of dimensional accuracy of the electrophotographic photosensitive member may decrease to vary the distance between the charger and the electrophotographic photosensitive member. This reduces charging uniformity (causes charging non-uniformity), resulting in image density non-uniformity.

Japanese Patent Application Laid-Open No. 2007-179025 discloses a method in which a stress relaxing section configured to relax stress acting between the substrate and the photoconductive layer is provided in a non-latent-image-formation area in order to suppress the end deformation of the substrate and the film peel-off at the ends of the electrophotographic photosensitive member.

Furthermore, Japanese Patent Application Laid-Open No. 2004-354967 discloses a method of improving the shape of ends of the substrate to suppress the deformation.

However, in these conventional techniques, the stress relaxing section is provided after formation of the a-Si deposited film. This leads to the need for mechanical processing such as cutting of the electrophotographic photosensitive member, chemical treatment such as etching treatment, and processing of the substrate. Thus, the manufacturing costs of the electrophotographic photosensitive member are likely to increase. Furthermore, the above-described conventional techniques can restrain the film from being peeled off over time when the electrophotographic photosensitive member is used to form images but fail to sufficiently suppress the end deformation of the electrophotographic photosensitive member resulting from a variation in temperature.

SUMMARY OF THE INVENTION

An object of the present invention is to provide an electrophotographic photosensitive member that allows suppression of end deformation and film peel-off at the ends of the electrophotographic photosensitive member, which may cause image density non-uniformity and image defects, as well as an electrophotographic apparatus having the electrophotographic photosensitive member.

The present invention provides an electrophotographic photosensitive member having a cylindrical substrate and a photoconductive layer provided on the cylindrical substrate and formed of amorphous silicon containing hydrogen atoms, wherein when an average value of the content ratio of the hydrogen atoms to the sum of silicon atoms and the hydrogen atoms in a central portion area of the photoconductive layer in the cylindrically axial direction thereof is denoted by Hx_ave [atom %], the content ratio of the hydrogen atoms to the sum of the silicon atoms and the hydrogen atoms at an arbitrary point in the central portion area is denoted by Hx [atom %], an average value of the content ratio of the hydrogen atoms to the sum of the silicon atoms and the hydrogen atoms in an end area of the photoconductive layer in the cylindrically axial direction thereof is denoted by Hy_ave [atom %], and the content ratio of the hydrogen atoms to the sum of the silicon atoms and the hydrogen atoms at an arbitrary point in the end area is denoted by Hy [atom %], Hx_ave, Hx, Hy_ave and Hy satisfy Expressions 1 to 4:

$$10 \leq Hx_ave \leq 30 \quad \text{(Expression 1)}$$

$$Hx < Hy \quad \text{(Expression 2)}$$

$$|Hx_ave - Hx| \leq 5 \quad \text{(Expression 3)}$$

$$2 \leq Hy_ave - Hx_ave \leq 12 \quad \text{(Expression 4).}$$

Furthermore, the present invention provides an electrophotographic apparatus having the above-described electrophotographic photosensitive member, a charging device, an imagewise exposure device, a developing device and a transfer device.

The present invention can provide an electrophotographic photosensitive member that allows suppression of end deformation and film peel-off at the ends of the electrophotographic photosensitive member, which may cause image density non-uniformity and image defects, as well as an electrophotographic apparatus having the electrophotographic photosensitive member.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

<Electrophotographic Photosensitive Member>

Figure 1:
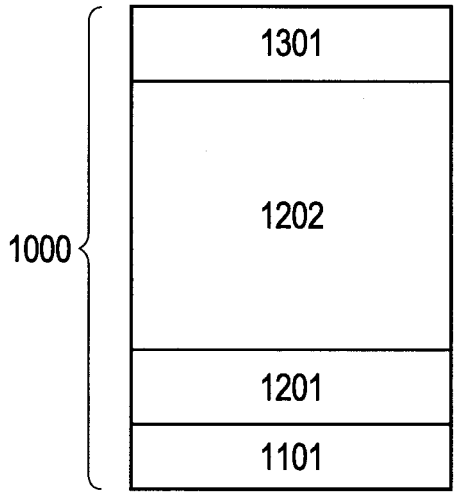
FIG. 1 is a cross-sectional view illustrating an example of a layer configuration of an electrophotographic photosensitive member.

FIG. 1 is a cross-sectional view illustrating an example of a layer configuration of an electrophotographic photosensitive member. An electrophotographic photosensitive member 1000 illustrated in FIG. 1 includes a substrate (cylindrical substrate) 1101 and a photoconductive layer 1202 formed on the substrate 1101. The electrophotographic photosensitive member 1000 further includes a charge injection blocking layer 1201 between the substrate 1101 and the photoconductive layer 1202 and a surface layer 1301 on the photoconductive layer 1202.

Figure 2:
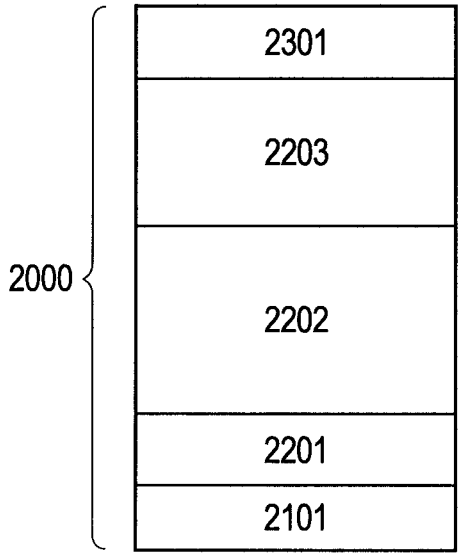
FIG. 2 is a cross-sectional view illustrating an example of a layer configuration of a two-layered photoconductive layer in the electrophotographic photosensitive member.

Furthermore, FIG. 2 is a cross-sectional view illustrating an example of a layer configuration of a two-layered photoconductive layer in the electrophotographic photosensitive member. The electrophotographic photosensitive member 2000 illustrated in FIG. 2 has a substrate (cylindrical substrate) 2101, a first photoconductive layer 2202 formed on the substrate 2101 and a second photoconductive layer 2203 formed on the first photoconductive layer 2202. The electrophotographic photosensitive member 2000 further has a charge injection blocking layer 2201 between the substrate 2101 and the first photoconductive layer 2202 and a surface layer 2301 on the second photoconductive layer 2203.

(Substrate (Cylindrical Substrate))

The substrate may be conductive (a conductive substrate, or cylindrical conductive substrate). Examples of materials for the substrate may include copper, aluminum, nickel, cobalt, iron, chromium, molybdenum and titanium, and alloys thereof. Among these materials, aluminum (aluminum alloy) is preferable in terms of processability and manufacturing costs. Examples of preferred aluminum alloys are an Al—Mg alloy and an Al—Mn alloy.

Furthermore, the surface of the substrate may be subjected to mirror-like cut finishing before treatment in a substrate washing apparatus.

(Photoconductive Layer)

The photoconductive layer formed on the cylindrical substrate needs to be configured using a material sensitive to light such as imagewise exposure light which irradiates the electrophotographic photosensitive member. In the present invention, the photoconductive layer is formed of a-Si (amorphous silicon containing hydrogen atoms).

The content of hydrogen atoms in the a-Si photoconductive layer can be appropriately changed in accordance with the required characteristics of the electrophotographic photosensitive member. The required characteristics of the electrophotographic photosensitive member can be obtained by bonding hydrogen atoms contained in the photoconductive layer to dangling bonds that are uncombined hands of silicon atoms or changing the network of the silicon atoms. The coefficient of thermal expansion, which is an important characteristic according to the present invention, can also be changed. For a change in the coefficient of thermal expansion, a large number of hydrogen atoms contained in the a-Si photoconductive layer serve to suppress the three-dimensional network of the silicon atoms. This makes the structure flexible, allowing possible stress to be relaxed. Thus, in connection with stress attributed to the coefficient of thermal expansion, an area with a low content of hydrogen atoms is arranged adjacent to an area with a high content of hydrogen atoms. Then, stress generated in the area with the low content of hydrogen atoms can be relaxed by the structural flexibility of the area with the high content of hydrogen atoms. Furthermore, an area with a high content of hydrogen atoms is provided in a portion of the photoconductive layer in which stress is likely to concentrate in connection with the structure thereof and in a portion of the photoconductive layer which is weaker than the other portions. This allows end deformation of the substrate and the electrophotographic photosensitive member to be suppressed. The portion in which stress is likely to concentrate in connection with the structure thereof and the portion weaker than the other portions is, for example, an end of an opening in the substrate which is formed like a cantilever.

As described above, in the present invention, the content of hydrogen atoms in the a-Si photoconductive layer is adjusted to vary between a central portion area and an end area in a cylindrical axial direction (the long axis direction of the cylindrical electrophotographic photosensitive member) as described below. The central portion area includes a latent image formation area (image formation area) and occupies most of the electrophotographic photosensitive member. Specifically, in terms of costs, the central portion area preferably occupies at least 60% of the electrophotographic photosensitive member in the cylindrically axial direction thereof and more preferably occupies at least 75% of the electrophotographic photosensitive member in the cylindrically axial direction thereof provided that the characteristics of the electrophotographic photosensitive member can be kept uniform. Furthermore, the end area is located in a non-latent-image-formation area (non-image-formation area). If a flange is used which allows the electrophotographic photosensitive member to operate in conjunction with movement of a rotating shaft of the electrophotographic apparatus, the end area includes a portion with the flange installed therein. If the flange is used, then in terms of costs, the end area is preferably set to occupy less than 30% of the electrophotographic photosensitive member in the cylindrically axial direction thereof taking into account an area processed (for example, mating processing) for the portion with the flange installed therein. The central portion area of the photoconductive layer in the cylindrically axial direction thereof is hereinafter also referred to as the "central portion area of the photoconductive layer" or simply the "central portion area". Additionally, the end area of the photoconductive layer in the cylindrically axial direction thereof is hereinafter referred to as the "end area of the photoconductive layer" or simply the "end area".

Specific adjustment of the content of the hydrogen atoms in the a-Si photoconductive layer according to the present invention is as follows. When the average value of the content ratio of the hydrogen atoms to the sum of the silicon atoms and the hydrogen atoms in the central portion area of the photoconductive layer is denoted by Hx_ave [atom %], the content ratio of the hydrogen atoms to the sum of the silicon atoms and the hydrogen atoms at an arbitrary point in the central portion area is denoted by Hx [atom %], the average value of the content ratio of the hydrogen atoms to the sum of the silicon atoms and the hydrogen atoms in the end area is denoted by Hy_ave [atom %], and the content ratio of the hydrogen atoms to the sum of the silicon atoms and the hydrogen atoms at an arbitrary point in the end area is denoted by Hy [atom %], the Hx_ave, Hx, Hy_ave and Hy satisfy Expressions 1 to 4:

$$10 \leq Hx_ave \leq 30 \quad \text{(Expression 1)}$$

$$Hx < Hy \quad \text{(Expression 2)}$$

$$|Hx_ave - Hx| \leq 5 \quad \text{(Expression 3)}$$

$$2 \leq Hy_ave - Hx_ave \leq 12 \quad \text{(Expression 4).}$$

The content ratio of the hydrogen atoms to the sum of the silicon atoms and the hydrogen atoms is hereinafter also simply referred to as the "content of the hydrogen atoms".

In the present invention, as indicated in Expression 1, the average value Hx_ave [atom %] of the content of the hydrogen atoms in the central portion area of the photoconductive layer is adjusted such that 10 Hx_ave≤30. When the Hx_ave is smaller than 10 atom %, the number of dangling bonds increases, and the increasing of the number of dangling bonds causes the decreasing of the resistance of the a-Si photoconductive layer. This is likely to result in insufficient charging. When the Hx_ave is greater than 30 atom %, residual potential increases or images are likely to be fogged.

Furthermore, in the present invention, as indicated in Expression 2, the magnitude relationship between the content Hx [atom %] of the hydrogen atoms at an arbitrary point in the central portion area of the photoconductive layer and the content Hy [atom %] of the hydrogen atoms at an arbitrary point in the end area is adjusted such that Hx<Hy.

Furthermore, in the present invention, as indicated in Expression 3, the absolute value |Hx_ave−Hx| of the difference between the average value Hx_ave [atom %] of the content of the hydrogen atoms at an arbitrary point in the central portion area of the photoconductive layer and the content ratio Hx [atom %] of the hydrogen atoms to the sum of the silicon atoms and the hydrogen atoms at an arbitrary point in the central portion area is adjusted such that |Hx_ave−Hx|≤5. Above-described Expression 3 indicates a variation in the content of the hydrogen atoms in the central portion area and relates to the uniformity of characteristics of the electrophotographic photosensitive member in the electrostatic latent image formation area. Thus, when the |Hx_ave−Hx| is greater than 5 percentage points, sensitivity non-uniformity or charging non-uniformity may occur, and the image density is likely to be non-uniform.

Additionally, in the present invention, as indicated in Expression 4, the difference Hy_ave−Hx_ave between the average value Hy_ave [atom %] of the content of the hydrogen atoms in the end area of the photoconductive layer and the average value Hx_ave [atom %] of the content of the hydrogen atoms in the central portion area is adjusted such that 2≤Hy_ave−Hx_ave≤12. When the Hy_ave−Hx_ave is smaller than 2 percentage points, the effect of suppressing the above-described stress is insufficient. When the Hy_ave−Hx_ave is greater than 12 percentage points, the film is likely to be peeled off in the areas other than the ends of the electrophotographic photosensitive member as a result of the significant difference of the film quality between the central portion area and the end area.

Moreover, in the present invention, the content of the hydrogen atoms in the end area of the photoconductive layer preferably increases progressively toward the end of the photoconductive layer in the cylindrically axial direction thereof in order to enhance the effect of relaxing stress. This is because if the content of the hydrogen atoms increases and decreases repeatedly toward the end, a portion of the photoconductive layer with a low content of hydrogen atoms may weaken the stress relaxation effect of a portion of the photoconductive layer with a high content of hydrogen atoms, slightly degrading the effect of relaxing stress.

Furthermore, the content of the hydrogen atoms may be appropriately adjusted in accordance with the wavelength of light such as imagewise exposure light with respect to the layer thickness direction of the photoconductive layer. An increase in the content of the hydrogen atoms in the photoconductive layer tends to increase optical band gap, shifting the peak of sensitivity to shorter wavelengths.

In addition to the adjustment of the content of the hydrogen atoms, a technique to contain atoms for controlling conductivity (electric conductivity) in the photoconductive layer may be used. The atoms for controlling conductivity are hereinafter also referred to as the "conductivity controlling atoms".

Furthermore, as illustrated in FIG. 2, the layer quality of the photoconductive layer may be changed such that the photoconductive layer is formed of multiple layers such as a first photoconductive layer and a second photoconductive layer.

Examples of the conductivity controlling atoms include what is called impurities in the field of semiconductors. For example, atoms belonging to group 13 in the periodic table (these atoms are hereinafter also referred to as "group 13 atoms") and atoms belonging to group 15 in the periodic table (these atoms are hereinafter also referred to as "group 15 atoms") may be used. Specific examples of the group 13 atoms include boron (B), aluminum (Al), gallium (Ga), indium (In) and thallium (Tl). Among these atoms, B, Al and Ga are preferable. Specific examples of the group 15 atoms include nitrogen (N), phosphorous (P), arsenic (As), antimony (Sb) and bismuth (Bi). Among these atoms, P, As and Sb are preferable.

The content of the conductivity controlling atoms in the photoconductive layer is preferably 0.05 atom ppm to atom ppm. Furthermore, the conductivity controlling atoms may essentially not be contained in portions of the photoconductive layer reached by imagewise exposure light.

Additionally, helium atoms may be contained in the photoconductive layer in connection with the controllability of physical properties and easiness with which the layer is formed.

The photoconductive layer is preferably 10 to 50 μm, more preferably 15 to 45 μm, and most preferably 20 to 40 μm in layer thickness. The increased layer thickness of the photoconductive layer allows electrophotographic characteristics such as charging ability and sensitivity to be sufficiently obtained. The reduced layer thickness of the photoconductive layer allows the photoconductive layer to be more efficiently formed.

The a-Si photoconductive layer may be formed by any one of the film formation methods including a vacuum deposition method, a sputtering method, a thermal CVD method, a photo CVD method and a plasma CVD method. Among these film formation methods, the plasma CVD method using a plasma CVD apparatus is preferable.

The formation of an a-Si photoconductive layer by the plasma CVD method involves, for example, introducing material gas for the supply of silicon atoms and material gas for the supply of hydrogen atoms, in a desired gas state, into a reaction container allowing a reduction in the internal pressure thereof, and inducing glow discharge in the reaction container to deposit an a-Si deposited film for the photoconductive layer on the substrate installed at a predetermined position.

Examples of the material gas (material substance) for the supply of silicon atoms include silicon hydroxides (silanes) such as $SiH_4$, $Si_2H_6$, $Si_3H_8$ and $Si_4H_{10}$ which are in the gas state or which can be converted into gas. Among these substances, in terms of the easiness with which the substance is handled during formation of a layer and the efficiency of supply of silicon atoms, $SiH_4$ and $Si_2H_6$ are preferable. For each material gas, one type may be exclusively used or a plurality of types may be used by mixing the plurality of types of gas in a predetermined mixture ratio. Furthermore, in view of controllability of the physical properties of the layer and convenience of supply of the material gas, the material gas may be mixed with another gas such as $H_2$, He or a silicon compound containing hydrogen atoms in a predetermined mixture ratio.

Examples of material gas (material substance) for the supply of boron atoms that are group 13 atoms include boron hydrides such as $B_2H_6$, $B_4H_{10}$, $B_5H_9$, $B_5H_{11}$, $B_6H_{10}$, $B_6H_{12}$ and $B_6H_{14}$ and boron halides such as $BF_3$, $BCl_3$ and $BBr_3$. Examples of the other material gas (material substance) for the supply of group 13 atoms include $AlCl_3$, $GaCl_3$, $Ga(CH_3)_3$, $InCl_3$ and $TlCl_3$.

Examples of material gas (material substance) for the supply of phosphorous atoms that are group 15 atoms include phosphorous hydrides such as $PH_3$ and $P_2H_4$ and phosphorous halides such as $PH_4I$, $PF_3$, $PF_5$, $PCl_5$, $PBr_3$, $PBr_5$ and $PI_3$. Examples of the other material gas (material substance) for the supply of group 15 atoms include $AsH_3$, $AsF_3$, $AsCl_3$, $AsBr_3$, $AsF_5$, $SbH_3$, $SbF_3$, $SbF_5$, $SbCl_3$, $SbCl_3$, $BiH_3$, $BiCl_3$ and $BiBr_3$.

The material gas (material substance) for the supply of the conductivity controlling atoms may be diluted with $H_2$ or rare gas such as He, Ar or Ne.

Formation of a photoconductive layer with the desired characteristics using any of the above-described material gas (material substances) may be achieved by adjusting the mixture ratio of the material gas for the supply of silicon atoms, the material gas for the supply of hydrogen atoms, and the diluted gas, the pressure of the gas in the reaction container (the pressure in the reaction container), discharge power (high-frequency power) and the substrate temperature.

The flow rate of $H_2$ or He used as diluted gas may be adjusted in accordance with layer design. The flow rate of the diluted gas is preferably 3 to 30 times, more preferably, 4 to 15 times, and most preferably 5 to 10 times, as high as that of the material gas for the supply of silicon atoms.

The pressure of the gas in the reaction container is preferably $1\times10^{-2}$ to $1\times10^{3}$ Pa, more preferably $5\times10^{-2}$ to $5\times10^{2}$ Pa, and most preferably $1\times10^{-1}$ to $2\times10^{2}$ Pa.

For the discharge power, the ratio of the discharge power to the flow rate of the material gas for the supply of silicon atoms is preferably 0.5 to 8 W/ml and more preferably 2 to 6 W/ml.

The temperature of the substrate is preferably 100 to 350° C., more preferably 150 to 330° C., and most preferably 180 to 300° C.

(Charge Injection Blocking Layer)

The charge injection blocking layer provides a function to inhibit charge from being injected from the substrate into the photoconductive layer when the surface of the electrophotographic photosensitive member is charged to a certain polarity. On the other hand, when the surface of the electrophotographic photosensitive member is charged to the opposite polarity, such a function is normally not fulfilled. The function has what is called a polarity dependence. To provide the charge injection blocking layer with such a function, more conductivity controlling atoms are contained in the charge injection blocking layer than in the photoconductive layer.

The conductivity controlling atoms contained in the charge injection blocking layer may be evenly and uniformly distributed in the charge injection blocking layer or may be evenly contained in a layer thickness direction but non-uniformly distributed in some portions.

If the distribution concentration of the conductivity controlling atoms is non-uniform, the conductivity controlling atoms are preferably contained such that more conductivity controlling atoms are distributed in areas closer to the substrate. Examples of the conductivity controlling atoms contained in the charge injection blocking layer include group 13 atoms and group 15 atoms similar to those for the photoconductive layer.

The content of the conductivity controlling atoms in the charge injection blocking layer is preferably 10 to $1\times10^{-4}$ atom ppm, more preferably 50 to $5\times10^{-3}$ atom ppm, and most preferably $1\times10^{-2}$ to $1\times10^{-3}$ atom ppm.

The charge injection blocking layer can be formed using a film formation method and material gas (material substance) similar to those for the photoconductive layer. A charge injection blocking layer with the desired characteristics may be formed by adjusting the mixture ratio of the material gas for the supply of silicon atoms, the material gas for the supply of hydrogen atoms, the material gas for the supply of conductivity controlling atoms and the diluted gas, the pressure of the gas in the reaction container (the pressure in the reaction container), the discharge power (high-frequency power) and the substrate temperature.

(Surface Layer)

Suitable materials used for the surface layer include amorphous silicon that is an amorphous material containing silicon atoms serving as a base material and hydrogen atoms, and amorphous silicon carbide (hereinafter also referred to as "a-SiC:H") containing silicon and carbon atoms serving as base materials, and hydrogen atoms. Other suitable materials used for the surface layer include amorphous silicon oxide (hereinafter also referred to as "a-SiO:H") containing silicon and oxygen atoms serving as base materials, and hydrogen atoms and amorphous silicon nitride (hereinafter also referred to as "a-SiN:H") containing silicon and nitrogen atoms serving as base materials, and hydrogen atoms.

The surface layer can be formed using a film formation method and material gas (material substance) similar to those used for the photoconductive layer and the charge injection blocking layer.

Examples of material gas (material substance) for the supply of carbon atoms include hydrocarbons such as $CH_4$, $C_2H_6$, $C_3H_8$ and $C_4H_{10}$ which are in the gas state or which can be converted into the gas state. Among these substances, in terms of the easiness with which the substance is handled during formation of a layer and the high efficiency of supply of carbon atoms, $CH_4$ and $C_2H_6$ are preferable.

The material gas (material substance) for the supply of carbon atoms may be diluted with $H_2$ or rare gas such as He, Ar or Ne.

The surface layer is preferably 0.01 to 3 μm, more preferably 0.05 to 2 μm, and most preferably 0.1 to 1 μm, in layer thickness. The increased layer thickness of the surface layer serves to suppress the loss of the surface layer even with possible wear during use. The reduced layer thickness of the surface layer serves to restrain the electrophotographic characteristics from being degraded as a result of an increase in residual potential and a variation in sensitivity.

(Deposited Film Formation Apparatus)

Figure 3:
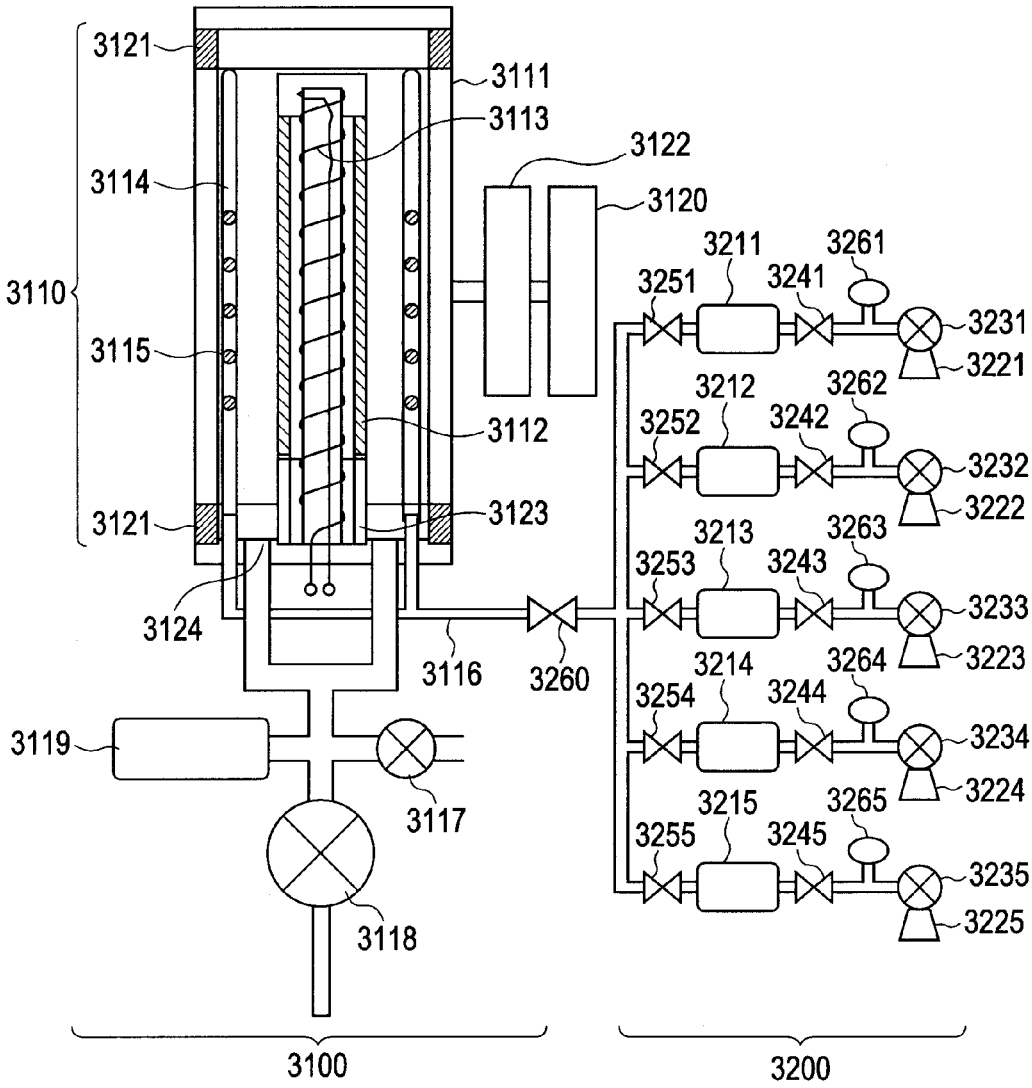
FIG. 3 is a diagram illustrating an example of a deposited film formation apparatus configured to form a deposited film with the aid of an RF plasma CVD method.

FIG. 3 is a diagram illustrating an example of a deposited film formation apparatus configured to form a deposited film by the RF plasma CVD method and which can be used to manufacture an electrophotographic photosensitive member according to the present invention.

The deposited film formation apparatus is formed mainly of a deposition device 3100 with a reaction container 3110, a material gas supply device 3200, and an exhaust device (not illustrated in the drawings) configured to reduce the internal pressure of the reaction container 3110.

The reaction container 3110 contains a cylindrical substrate 3112 connected to the ground, cylindrical-substrate heaters 3113, and a material gas introduction pipe 3114. The cylindrical-substrate heaters 3113 are installed so as to correspond to relevant cylindrically axial positions in the cylindrical substrate 3112. Thus, the amount of heating can be controlled at the cylindrically axial positions in the cylindrical substrate 3112. Furthermore, the distribution of the amount of the material gas introduced into the reaction container 3110 is controlled based on the positions of gas entries 3115 in the gas introduction pipe 3114. In FIG. 3, five gas entries 3115 are provided per gas introduction pipe. However, the number of the gas entries 3115 is preferably appropriately adjusted.

A high-frequency power source 3120 is connected to a cathode 3111 via a high-frequency matching box 3122.

The material gas supply device 3200 includes gas cylinders for material gas such as $SiH_4$, $H_2$, $CH_4$, NO, $B_2H_6$ or $CF_4$, that is, material gas cylinders 3221 to 3225. The material gas supply device 3200 also includes valves 3231 to 3235, inflow valves 3241 to 3245, and outflow valves 3251 to 3255 as valves for adjusting the amount of gas. The material gas supply device 3200 further includes pressure regulators 3261 to 3265 and mass flow controllers 3211 to 3215.

A method of forming a deposited film for each layer in the electrophotographic photosensitive member using the deposited film formation apparatus illustrated in FIG. 3 will be described.

First, the cylindrical substrate 3112 is installed in the reaction container 3110 via a cradle 3123. Then, the exhaust device (not illustrated in the drawings) is operated to evacuate the reaction container 3110. The operator views an indication on a vacuum gauge 3119, and when the pressure in the reaction container 3110 reaches a predetermined value (for example, 1 Pa or less), supplies power to the cylindrical-substrate heaters 3113 to heat the cylindrical substrate 3112 to a predetermined temperature (for example, 100 to 350° C.). At this time, the gas supply device 3200 may be used to supply inert gas such as Ar or He to the reaction container 3110. Thus, heating can be carried out in an inert gas atmosphere.

The gas supply device 3200 supplies the reaction container 3110 with gas used to form a deposited film for each layer (for example, the charge injection blocking layer, the photoconductive layer, and the surface layer) forming the electrophotographic photosensitive member, depending on the layer. That is, the valves 3231 to 3235, the inflow valves 3241 to 3245, and the outflow valves 3251 to 3255 are opened as required to set the flow rate of gas for the mass flow controllers 3211 to 3215. When the gas flow rate is stabilized in each mass flow controller, the operator views the indication on the vacuum gauge 3119, while operating the main valve 3118 to adjust the pressure in the reaction container 3110 to a predetermined value. When the predetermined pressure is obtained, the high-frequency power source 3120 is used to apply high-frequency power. Furthermore, the high-frequency matching box 3122 is operated to induce plasma discharge in the reaction container 3110. Thereafter, the high-frequency power is quickly adjusted to a predetermined value to form a deposited film for the layer.

The content of the hydrogen atoms in the photoconductive layer is adjusted by, for example, controlling heating, by the cylindrical-substrate heaters 3113, of the cylindrical substrate 3112 in the cylindrically axial direction or controlling the distribution of the amount of introduced material gas based on the positions of the gas entries 3115. The method for adjusting the content of hydrogen atoms varies depending on the deposited film formation apparatus used, the flow rate of introduced gas, the mixture ratio of gas, the pressure in the reaction container, and the high-frequency power.

If deposited films for a plurality of layers are formed, the application of the high-frequency power is stopped when the deposited film for one of the layers reaches a predetermined film thickness (layer thickness). Then, the above-described procedure is repeated to form the respective layers. Alternatively, the deposited films may be formed by consecutively re-setting the high-frequency power, the type and flow rate of the material gas, the power supplied to the cylindrical-substrate heaters 3113, and the pressure in the reaction container 3110. For example, the flow rate and pressure of the material gas may be changed in a predetermined time to values corresponding to conditions for the next layer to be formed, to form a changing layer (intermediate layer).

Once all of the deposited films for the predetermined layers are formed as described above, the application of the high-frequency power is stopped. Then, the valves 3231 to 3235, the inflow valves 3241 to 3245, the outflow valves 3251 to 3255, and an auxiliary valve 3260 are closed. The supply of the material gas is ended. Furthermore, the main valve 3118 is opened to evacuate the reaction container 3110 to a pressure of at most 1 Pa.

When the deposited film for each layer is formed as described above, the main valve 3118 is closed. Then, inert gas is introduced into the reaction container 3110 to return the inside of the reaction container to the atmospheric pressure. Thereafter, the cylindrical substrate 3112 with the deposited film for each layer formed therein is taken out of the reaction container 3110.

Energy used to generate plasma may be any one of DC, RF, microwave, and electromagnetic wave in a VHF band. The energy may be used depending on the desired characteristics of the layer.

The electrophotographic photosensitive member thus manufactured is not only used in an electrophotographic copier but can also be widely used for electrophotographic applications such as a laser beam printer, a CRT printer, a LED printer, a liquid crystal printer and a laser plate maker.

The present invention will be described in further detail with reference to examples and comparative examples. In the following examples and comparative examples, the image formation area corresponds to the central portion area, and the non-image-formation areas correspond to the end areas.

Example 1 and Comparative Examples 1 and 2

First, electrophotographic photosensitive members in Example 1 and Comparative Examples 1 and 2 were produced.

In Example 1, the electrophotographic photosensitive member was produced such that the content of the hydrogen atoms in the end area of the photoconductive layer was higher than that in the central portion area and such that the average value Hx_ave [atom %] of the content of the hydrogen atoms in the central portion area was about 25 atom %.

In Comparative Example 1, the electrophotographic photosensitive member was produced such that the content of the hydrogen atoms in the central portion area of the photoconductive layer was equivalent to that in the end area and such that the average value Hx_ave [atom %] of the content of the hydrogen atoms in the central portion area and the average value Hy_ave [atom %] of the content of the hydrogen atoms in the end area were both about 25 atom %.

In Comparative Example 2, on the contrary to Example 1, the electrophotographic photosensitive member was produced such that the content of the hydrogen atoms in the end area of the photoconductive layer was smaller than that in the central portion area and such that the average value Hx_ave [atom %] of the content of the hydrogen atoms in the central portion area was about 25 atom %.

The three types of electrophotographic photosensitive members were produced by using the deposited film formation apparatus illustrated in FIG. 3 and using an RF band as a frequency and a cylindrical aluminum conductive substrate as a substrate (cylindrical substrate); the cylindrical aluminum conductive substrate had a diameter of 80 mm, a length of 358 mm, and a thickness of 3 mm and was subjected to mirror-like finishing.

At this time, in Example 1, to make the content of the hydrogen atoms in the end area of the photoconductive layer higher than that in the central portion area, the following adjustment was carried out. That is, the cylindrical-substrate heaters 3113 in FIG. 3 were adjusted such that a heater set temperature for the central portion area was higher than that for the end area. Furthermore, the positions of the gas entries 3115 in FIG. 3 were adjusted. Specifically, the positions of the gas entries 3115 were adjusted such that a greater number of gas entries 3115 were formed in the end area, in which a greater number of hydrogen atoms needed to be contained, compared to positions where the distribution of the content of hydrogen atoms was uniform (these positions are hereinafter also referred to as the "standard positions").

At this time, a charge injection blocking layer, a photoconductive layer, and a surface layer were sequentially formed at the respective substrate temperatures (heater set temperatures corresponding to substrate heating temperatures), the respective pressures in the reaction container, the respective values of the high-frequency power, and the respective $SiH_4$, $H_2$, $B_2H_6$, NO and $CH_4$ flow rates, which are required to form the corresponding layers. In tables illustrated below, the "heater set temperature for the central portion area" is the temperature at a central position of the cylindrical substrate in the cylindrically axial direction. The "heater set temperature for the end area" is the temperature at a distance of 30 mm from the end of the cylindrical substrate in the cylindrically axial direction.

TABLE 1

| | Charge injection blocking layer | Photoconductive layer | Surface layer |
|---|---|---|---|
| Type and flow rate of gas | | | |
| $SiH_4$ [ml/min] [normal] | 300 | 150 | 25 |
| H2 [ml/min][normal] | 650 | 800 | — |
| $B_2H_6$ [ppm vs. $SiH_4$] | 2000 | 0.7 | — |
| NO [ml/min][normal] | 5 | — | — |
| $CH_4$ [ml/min] [normal] | — | 260 | — |
| Heater set temperature for central portion area [° C.] | 300 | 320 | 310 |

TABLE 1-continued

| | Charge injection blocking layer | Photoconductive layer | Surface layer |
|---|---|---|---|
| Heater set temperature for end area [° C.] | | 310 | |
| Pressure in reaction container [Pa] | 40 | 70 | 80 |
| High-frequency power [W] | 400 | 400 | 300 |
| Layer thickness [μm] | 3 | 30 | 1 |

In Comparative Example 1, the heater set temperature for the central portion area, the heater set temperature for the end area, and the positions of the gas entries 3115 illustrated in FIG. 3 were changed from those in Example 1. Specifically, in Comparative Example 1, the heater set temperature for the central portion area was also set the same as that for the end area when a photoconductive layer was formed. Furthermore, the positions of the gas entries 3115 were unchanged; the gas entries 3115 were arranged at the standard positions.

In Comparative Example 2, the cylindrical-substrate heaters 3113 in FIG. 3 were adjusted such that the heater set temperature for the central portion area was lower than that for the end area. Furthermore, the positions of the gas entries 3115 were adjusted such that a smaller number of gas entries 3115 were provided in the end area, where a smaller ratio of hydrogen atoms needed to be contained.

With regards to film formation conditions (layer formation conditions) for production of an electrophotographic photosensitive member in Comparative Examples 1 and 2, the same conditions as those in Example 1 were used for the charge injection blocking layer and the surface layer, and conditions illustrated in Table 2 were used for the photoconductive layer.

In each example, two electrophotographic photosensitive members were produced.

TABLE 2

| | Comparative Example 1 | Comparative Example 2 |
|---|---|---|
| Type and flow rate of gas | | |
| $SiH_4$ [ml/min] [normal] | 150 | 150 |
| $H_2$ [ml/min] [normal] | 800 | 800 |
| $B_2H_6$ [ppm vs. $SiH_4$] | 0.7 | 0.7 |
| NO [ml/min] [normal] | — | — |
| $CH_4$ [ml/min] [normal] | — | — |
| Heater set temperature for central portion area [° C.] | 320 | 320 |
| Heater set temperature for end area [° C.] | 320 | 340 |
| Pressure in reaction container [Pa] | 70 | 70 |
| High-frequency power [W] | 400 | 400 |
| Layer thickness [μm] | 30 | 30 |

Analysis was carried out using one of the two electrophotographic photosensitive members produced in each of Example 1 and Comparative Examples 1 and 2.

Figure 4:
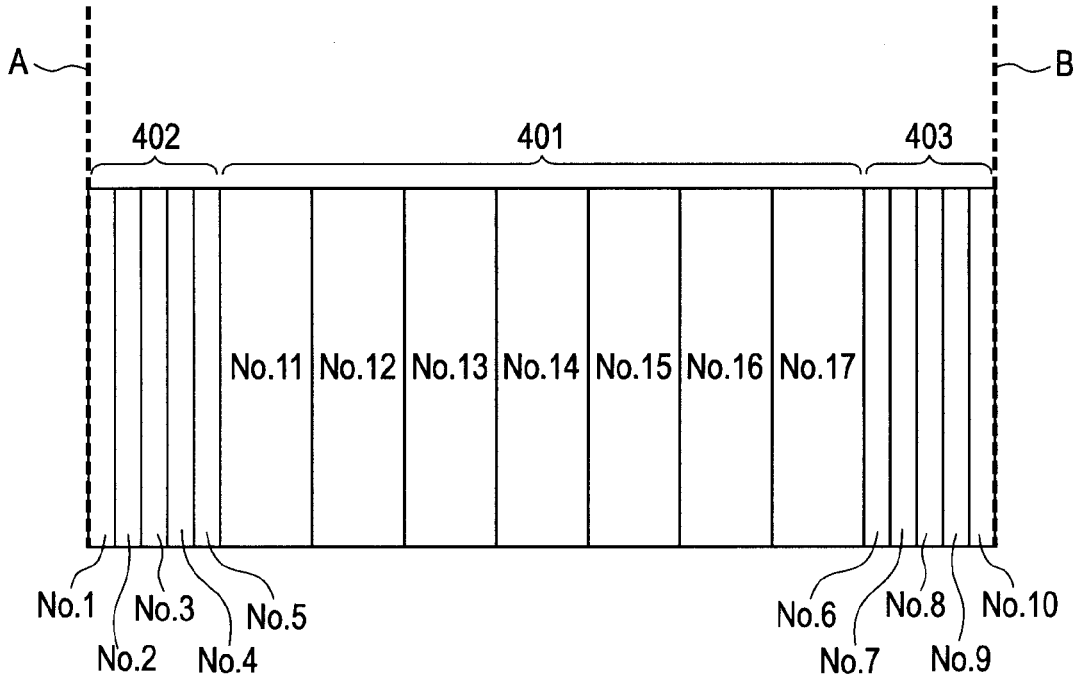
FIG. 4 is a diagram illustrating a central portion area, end areas and ends.

For the analysis, the central portion area 401 of the electrophotographic photosensitive member was divided into seven (7) small areas in the cylindrically axial direction thereof. Furthermore, for the end area, the opposite end areas 402 and 403 across the central portion area 401 were each divided into five (5) small areas. That is, the electrophotographic photosensitive member was divided into 17 small areas in the cylindrically axial direction thereof as illustrated in FIG. 4. Any three points in each of the 17 small areas were analyzed, and the average value for the small areas was determined, which corresponds to an analytical value for the small areas.

Specifically, one of the opposite ends of the electrophotographic photosensitive member was referred to as an end A. The end area including the end A was divided into five (5) equal small areas. The small area including the end A was referred to as a small area No. 1. The small areas arranged from the small area No. 1 toward the central portion area 401 were referred to as small areas No. 2, No. 3, No. 4 and No. 5 in order.

Like the end area 402 including the end A, an end area 403 including the opposite end, that is, the end B, was divided into five (5) equal small areas. The small area adjacent to the central portion area 401 was referred to as a small area No. 6. The small areas arranged from the small area No. 6 toward the end B were referred to as small areas No. 7, No. 8, No. 9 and No. 10 in order.

Furthermore, the central portion area 401 was divided into seven (7) small areas. The small area adjacent to the small area No. 5 in the end area was referred to as a small area No. 11. The small areas arranged from the small area No. 11 toward the small area No. 6 in the end area 403 were referred to as small areas No. 12, No. 13, No. 14, No. 15, No. 16 and No. 17 in order.

The small areas No. 1 to No. 5 in the end area 402 occupied 20% of the electrophotographic photosensitive member in the cylindrically axial direction thereof. The small areas No. 11 to No. 17 in the central portion area 401 occupied 60% of the electrophotographic photosensitive member in the cylindrically axial direction thereof. The small areas No. 6 to No. 10 in the end area 403 occupied 20% of the electrophotographic photosensitive member in the cylindrically axial direction thereof.

Each of the 17 small areas was analyzed according to an analysis method described below to calculate the content of the hydrogen atoms.

The average value Hx_ave [atom %] of the content of the hydrogen atoms in the central portion area 401 corresponded to the average value for the small areas No. 11 to No. 17. The average value Hy_ave [atom %] of the content of the hydrogen atoms in the end areas 402 and 403 corresponded to the average value for the small areas No. 1 to No. 10.

(Measurement of the Content of the Hydrogen Atoms in the Photoconductive Layer)

The content of the hydrogen atoms in the photoconductive layer was measured as follows.

The electrophotographic photosensitive member produced was cut in the cylindrically axial direction thereof to obtain samples with cross sections spreading in the layer thickness direction. Infrared absorption spectrum was measured on the samples resulting from the cutting under the same conditions. The content of the hydrogen atoms was measured based on the peak areas of an absorption peak close to 2,000 $cm^{-1}$ corresponding to Si—H stretching vibration and an absorption peak close to 2,090 $cm^{-1}$ corresponding to Si—$H_2$ stretching vibration.

The measurement of the infrared absorption spectrum was carried out on positions corresponding to the small areas using Spotlight 400 (trade name) manufactured by PerkinElmer Inc. and which performs IR imaging.

Furthermore, samples were produced by forming a photoconductive layer of film thickness 0.5 μm on glass at the positions corresponding to the 17 small areas under the same film formation conditions as those for the photoconductive layer; the glass is available from Corning Incorporated (trade name: 7059). The infrared absorption spectrum was measured on the samples by hydrogen forward scattering analysis (HFS). Similarly, the glass was changed to a silicon wafer, and a photoconductive layer was formed on the silicon wafer.

The infrared absorption spectrum was measured on the resultant samples. A back scattering measuring instrument (trade name: AN-2500 manufactured by NHV Corporation) was used to measure the content of the hydrogen atoms in a portion of the photoconductive layer located at a depth of 0.4 μm from the surface thereof by hydrogen forward scattering analysis (HFS). Thus, the content of the hydrogen atoms was calculated. A check was carried out on the infrared absorption spectrum of a cross section of the electrophotographic photosensitive member and the infrared absorption spectrum of the photoconductive layer formed on the silicon wafer for consistency. As a result, the rank order of the contents of the hydrogen atoms among the samples was determined not to have been reversed, allowing confirmation of the consistency. The values of the contents of the hydrogen atoms shown below are calculated from the infrared absorption spectra.

Table 3 shows the results of analysis in Example 1 and Comparative Examples 1 and 2.

TABLE 3

| | | Example 1 | Comparative Example 1 | Comparative Example 2 |
|---|---|---|---|---|
| | Hx_ave [atom %] | 25.1 | 25.0 | 25.1 |
| | Hy_ave [atom %] | 28.3 | 25.0 | 22.1 |
| | Hy_ave-Hx_ave [% age point] | 3.2 | −0.01 | −3.0 |
| | Maximum value of \|Hx_ave-Hx\| [% age point] | 2.0 | 1.6 | 0.7 |
| | Maximum value of Hx [atom %] | 26.3 | 26.2 | 25.8 |
| | Minimum value of Hy [atom %] | 26.7 | 24.5 | 20.7 |
| Content of hydrogen atoms in end area [atom %] | Small area No. 1 | 28.6 | 24.7 | 20.9 |
| | Small area No. 2 | 29.7 | 25.1 | 22.2 |
| | Small area No. 3 | 28.4 | 24.5 | 21.4 |
| | Small area No. 4 | 27.4 | 25.6 | 23.1 |
| | Small area No. 5 | 26.7 | 25.5 | 23.6 |
| | Small area No. 6 | 27.1 | 25.8 | 22.6 |
| | Small area No. 7 | 28.5 | 25.0 | 22.9 |
| | Small area No. 8 | 29.3 | 24.5 | 22.1 |
| | Small area No. 9 | 29.2 | 24.8 | 21.9 |
| | Small area No. 10 | 28.1 | 24.5 | 20.7 |
| Content of hydrogen atoms in central portion area [atom %] | Small area No. 11 | 26.3 | 26.2 | 24.4 |
| | Small area No. 12 | 25.6 | 25.9 | 25.0 |
| | Small area No. 13 | 24.5 | 24.8 | 25.3 |
| | Small area No. 14 | 23.1 | 24.5 | 25.6 |
| | Small area No. 15 | 24.6 | 23.4 | 24.8 |
| | Small area No. 16 | 25.6 | 24.5 | 25.8 |
| | Small area No. 17 | 26.2 | 25.8 | 25.1 |

In all of the electrophotographic photosensitive members Example 1 and Comparative Examples 1 and 2, the average value Hx_ave [atom %] of the content of the hydrogen atoms in the central portion area was about 25 atom % (25±1 atom %).

Furthermore, in Example 1, the average value Hy_ave [atom %] of the content of the hydrogen atoms in the end area was greater than the average value Hx_ave [atom %] of the content of the hydrogen atoms in the central portion area by 3.2 percentage points.

In the electrophotographic photosensitive member in Comparative Example 1, both the average value Hx_ave [atom %] of the content of the hydrogen atoms in the central portion area and the average value Hy_ave [atom %] of the content of the hydrogen atoms in the end area were 25.0 atom %; the hydrogen atoms were uniformly distributed.

In Comparative Example 2, the average value Hy_ave [atom %] of the content of the hydrogen atoms in the end area was smaller than the average value Hx_ave [atom %] of the content of the hydrogen atoms in the central portion area by 3.0 percentage points.

Furthermore, in Example 1, the minimum value of the content of the hydrogen atoms at an arbitrary point in the end area was greater than the maximum value of the content of the hydrogen atoms at an arbitrary point in the central portion area. This indicates that in the 17 small areas into which the photoconductive layer was divided, the content Hy [atom %] of the hydrogen atoms at an arbitrary point in the end area was higher than the content Hx [atom %] of the hydrogen atoms at an arbitrary point in the central portion area.

(Evaluation for End Deformation of the Electrophotographic Photosensitive Member, Evaluation for Film Peel-Off at the End of the Electrophotographic Photosensitive Member, and Evaluation for Image Density Non-Uniformity)

An electrophotographic photosensitive member different from the one for above-described analysis was used to carry out evaluations for the end deformation of the electrophotographic photosensitive member, the image density non-uniformity in output images obtained using the electrophotographic photosensitive member, and the film peel-off at the ends of the electrophotographic apparatus, by means of methods described below.

Figure 5:
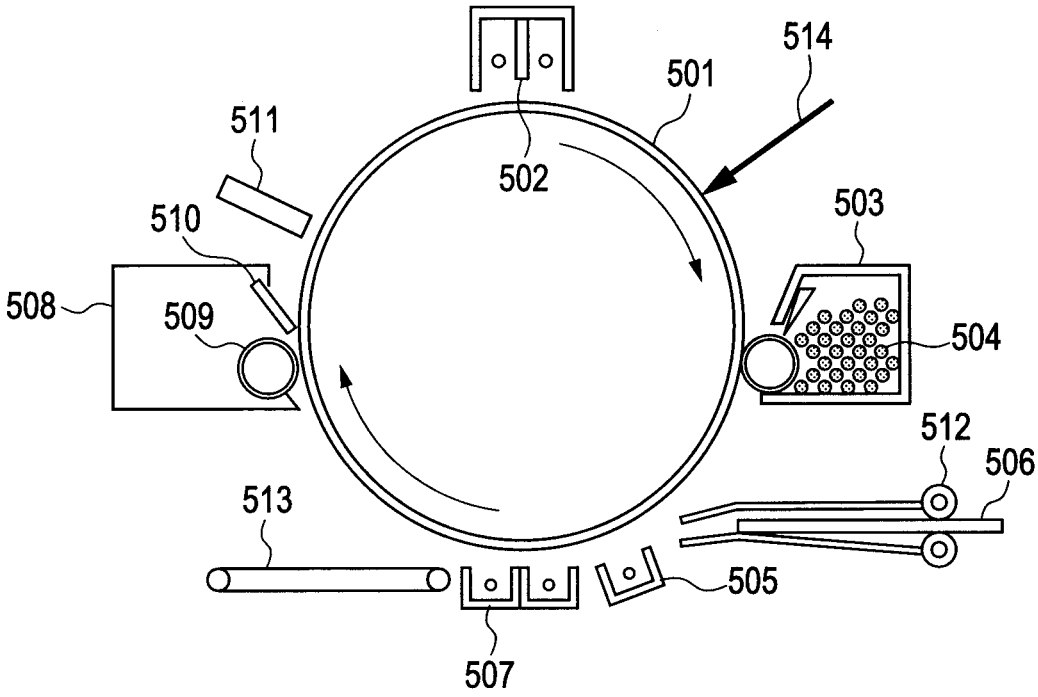
FIG. 5 is a diagram illustrating the configuration of an electrophotographic apparatus used in examples and comparative examples.

FIG. 5 illustrates the configuration of the electrophotographic apparatus used.

In FIG. 5, a primary charger (charging device) 502 charges a surface of an electrophotographic photosensitive member 501 with no electrostatic latent image formed yet. A developing device 503 supplies toner (developer) 504 to the electrophotographic photosensitive member 501 with an electrostatic latent image formed on the surface thereof. The developing device 503 then develops the electrostatic latent image to form a toner image on the surface of the electrophotographic photosensitive member 501. A transfer charging device (transfer device) 505 transfers toner 504 on the surface of the electrophotographic photosensitive member 501 to a transfer material 506 such as paper (the transfer charging device 505 shifts the toner 504 to the transfer material 506). A detach charger 507 reduces the electrostatic attractive force of the transfer material 506 to detach the transfer material 506 from the electrophotographic photosensitive member 501. A cleaning device 508 cleans (purifies) the surface of the electrophotographic photosensitive member 501. In the electrophotographic apparatus configured as illustrated in FIG. 5, the cleaning device 508 includes a magnet roller 509 and a cleaning blade 510 in order to effectively and uniformly purify the surface of the electrophotographic photosensitive member 501. A static elimination lamp (pre-exposure device (antistatic device)) 511 electrostatically eliminates electricity from the surface of the electrophotographic photosensitive member 501 to allow for the next image formation. A feed roller 512 feeds the transfer material 506 out, and a transportation unit 513 transports the transfer material 506 with an image formed thereon. An exposure light source (imagewise exposure device (electrostatic latent image forming device)) (not illustrated in the drawings) emits imagewise exposure light 514 with a single wavelength.

Evaluations were carried out as follows.

(Evaluation for the End Deformation of the Electrophotographic Photosensitive Member)

Figure 6:
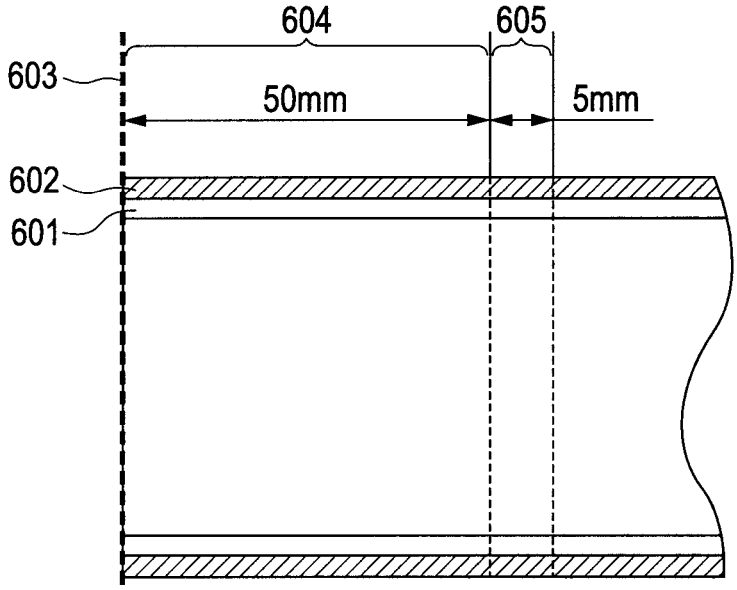
FIG. 6 is a diagram illustrating evaluation for end deformation of the electrophotographic photosensitive member in the examples and comparative examples.

Evaluation for the end deformation of the electrophotographic photosensitive member was carried out on an area illustrated in FIG. 6 as follows.

First, immediately after an electrophotographic photosensitive member was produced by forming a deposited film 602 including a photoconductive layer on a cylindrical substrate 601, the external shape of the electrophotographic photosensitive member was measured in a generatrix direction (cylindrically axial direction) from one end 603 toward the central portion area, at a deformation amount measurement position 604 (50 mm) and a horizontal reference 605 (5 mm) were measured. In connection with the result of the measurement for the deformation amount measurement position 604, based on a generatrix of width 5 mm corresponding to the horizontal reference, the maximum value of a deviation from the horizontal reference was calculated. The value obtained corresponds to the end deformation amount on one side. Similarly, the external shape of the electrophotographic photosensitive member was measured in the generatrix direction (cylindrically axial direction) from the other end toward the central portion area, at a distance of 50 mm from the other end. Thus, the end deformation amount on the other side was calculated. The average value of the two end deformation amounts obtained was then determined and corresponds to the end deformation amount of the electrophotographic photosensitive member.

The end deformation amount was measured using a three-dimensional measuring instrument manufactured by TOKYO SEIMITSU CO., LTD. (trade name: XYZAX, PA800A).

The end deformation of the electrophotographic photosensitive member was evaluated based on Comparative Example 1 by calculating the ratio of the value for the end deformation to the value for the end deformation in Comparative Example 1, serving as a denominator. Thus, when the calculated value was smaller than 1, the electrophotographic photosensitive member was determined to be more appropriate than that in Comparative Example 1 in terms of end deformation. The value for the end deformation in Comparative Example 1 was 0.035 mm (35 μm).

(Evaluation for the Image Density Non-Uniformity)

Image density non-uniformity was measured as follows.

The electrophotographic photosensitive member produced was installed in a digital electrophotographic apparatus manufactured by Canon Inc. (trade name: iR-5065) and configured as illustrated in FIG. 5. The electrophotographic apparatus was allowed to output halftone images, which were then evaluated for image density non-uniformity. At this time, the electrophotographic apparatus was adjusted to make the halftone images uniform in density. The adjustment was carried out as follows. First, the electrophotographic apparatus was allowed to output halftone images, and a reflecting density meter manufactured by X-Rite Inc. (trade name: 504) was used to measure reflecting density at an image position corresponding to the central position of the electrophotographic photosensitive member in the cylindrically axial direction thereof. Adjustment of the potential of the electrophotographic apparatus and output of images were then repeated so as to set the refection density to 0.75, thus adjusting the image density. The images were then evaluated for image density non-uniformity.

The evaluation was carried out as follows. For the output halftone images, the reflecting density meter manufactured by X-Rite Inc. (trade name: 504) was used to measure the image density at image positions corresponding to the seven small areas in the central portion area, at arbitrary three points in each of the small areas, and the average density was taken as the density of each small area. The difference between the maximum density and minimum density of the seven small areas was determined and regarded as the image density non-uniformity.

The image density non-uniformity was determined based on the following criterion.

A: less than 0.01

B: at least 0.01 and less than 0.02

C: at least 0.02 and less than 0.03

D: at least 0.03

In the determination criterion, rank B and higher ranks were determined to indicate that the effects of the present invention were provided.

(Evaluation for the Film Peel-Off at the Ends of the Electrophotographic Photosensitive Member)

For film peel-off, the outer peripheral surface of each end of the electrophotographic photosensitive member was visually checked for a film peel-off condition. The film peel-off condition was determined based on the following criterion.

A: the film is not peeled off and is appropriate.

B: the film is peeled off by at most 0.5 mm.

C: the film is peeled off by at least 0.5 mm and at most 1 mm.

D: the film is peeled off by at least 1 mm.

In the determination criterion, rank B and higher ranks were determined to indicate that the effects of the present invention were provided.

Table 4 shows the results of the evaluation for the end deformation of the electrophotographic photosensitive member, the evaluation for the image density non-uniformity, and the evaluation for the film peel-off at the ends of the electrophotographic photosensitive member. In the tables illustrated below, the "end deformation amount" indicates the result of the evaluation for the end deformation (end deformation amount) of the electrophotographic photosensitive member. The "image density non-uniformity" indicates the result of the evaluation for the image density non-uniformity. The "end film peel-off" indicates the result of the evaluation for the film peel-off at the ends of the electrophotographic photosensitive member.

TABLE 4

| | End deformation amount | Image density non-uniformity | End film peel-off |
|---|---|---|---|
| Example 1 | 0.66 | A | A |
| Comparative Example 1 | 1 | C | A |
| Comparative Example 2 | 1.57 | C | D |

In an electrophotographic photosensitive member in which the average value Hy_ave [atom %] of the content of the hydrogen atoms in the end area is greater than the average value Hx_ave [atom %] of the content of the hydrogen atoms in the central portion area, as is the case with Example 1, the end deformation and the image density non-uniformity are suppressed more appropriately than in a case of an average content of hydrogen atoms such as in Comparative Example 1.

Furthermore, in an electrophotographic photosensitive member in which contrary to Example 1, the average value Hy_ave [atom %] of the content of the hydrogen atoms in the end area is smaller than the average value Hx_ave [atom %] of the content of the hydrogen atoms in the central portion area as is the case with comparative Example 2, the end deformation amount is greater and the likelihood of the image density non-uniformity is higher than in Comparative Example 1, in which the content of the hydrogen atoms is uniform.

Thus, if the content of the hydrogen atoms is made uniform over the end areas and central portion area of the photoconductive layer, the following situation is expected. Stress is generated between the substrate and the photoconductive layer and concentrates at the ends of the substrate. This causes the ends of the substrate to be more significantly deformed, thus deforming the ends of the electrophotographic photosensitive member. As a result, the level of dimensional accuracy of the electrophotographic photosensitive member deceases, increasing the likelihood of image density non-uniformity.

When the content of the hydrogen atoms in the end area of the photoconductive layer is higher than that in the central portion area, a difference in the amount of heat shrinkage caused by a difference in the coefficient of thermal expansion is reduced to relax the stress between the substrate and the photoconductive layer. This suppresses the end deformation of the electrophotographic photosensitive member. The suppressed end deformation serves to increase the level of dimensional accuracy of the electrophotographic photosensitive member. This improves the positional relationship between the electrophotographic photosensitive member and the charger in the electrophotographic apparatus, thus suppressing a local increase in the wear volume of the surface of the electrophotographic photosensitive member. As a result, the likelihood of the image density non-uniformity is expected to be low.

Furthermore, if the content of the hydrogen atoms in the end area is lower than that in the central portion area as is the case with Comparative Example 2, exerting the effect of relaxing stress is expected to be difficult because the position of an area with a high content of hydrogen atoms which are effective for relaxing the stress is different from the positions of the ends, at which stress concentrates.

The results of the evaluations indicate as follows. When the content of the hydrogen atoms in the end area of the photoconductive layer is made higher than that in the central portion area, the end deformation of the electrophotographic photosensitive member is suppressed. This improves the level of dimensional accuracy of the electrophotographic photosensitive member, thus reducing the likelihood of the image density non-uniformity.

Examples 2 to 4

In Examples 2 to 4, electrophotographic photosensitive members were produced as follows. The average value Hx_ave [atom %] of the content of the hydrogen atoms in the central portion area of the photoconductive layer was changed to about 10 atom % (Example 2), to about 20 atom % (Example 3), and to about 30 atom % (Example 4). The content of the hydrogen atoms in the end area of the photoconductive layer was set higher than that in the central portion area.

In Examples 2 to 4, the cylindrical-substrate heaters 3113 in FIG. 3 were adjusted such that the heater set temperature for the central portion area was higher than that for the end area as in the case of Example 1. In Example 2 and Example 3, in order to make the content of the hydrogen atoms lower than in Example 1, the temperature of the cylindrical-substrate heaters 3113 was set higher than in Example 1. In Example 4, in order to make the content of the hydrogen atoms lower than in Example 1, the temperature of the cylindrical-substrate heaters 3113 was set lower than in Example 1.

Furthermore, the positions of the gas entries 3115 in FIG. 3 were adjusted in conjunction with the adjustment of the amount of the material gas. Specifically, a greater number of the gas entries 3115 were provided in the end area, in which a greater number of hydrogen atoms needed to be contained, as is the case with Example 1.

For the film formation conditions (layer formation conditions) in Examples 2 to 4, the electrophotographic photosensitive members were produced with the same conditions as those in Example 1 applied to the charge injection blocking layer and the surface layer and with conditions shown in Table 5 applied to the photoconductive layer.

Two electrophotographic photosensitive members were produced in each of Examples 2 to 4.

TABLE 5

| | Charge injection blocking layer | Photoconductive layer | Surface layer |
|---|---|---|---|
| Type and flow rate of gas | | | |
| $SiH_4$ [ml/min] [normal] | 35 | 90 | 200 |
| $H_2$ [ml/min] [normal] | 700 | 1000 | 1100 |
| $B_2H_6$ [ppm vs. $SiH_4$] | 0.7 | 0.7 | 0.7 |
| NO [ml/min] [normal] | — | — | — |
| $CH_4$ [ml/min] [normal] | — | — | — |
| Heater set temperature for central portion area [° C.] | 400 | 350 | 280 |
| Heater set temperature for end area [° C.] | 380 | 330 | 270 |
| Pressure in reaction container [Pa] | 70 | 70 | 70 |
| High-frequency power [W] | 450 | 400 | 350 |
| Layer thickness [μm] | 30 | 30 | 30 |

Analysis was carried out using each of the electrophotographic photosensitive members produced in Examples 2 to 4 as is the case with Example 1. Table 6 shows the results of the analysis.

TABLE 6

| | Example 2 | Example 3 | Example 4 |
|---|---|---|---|
| Hx_ave [atom %] | 10.4 | 20.3 | 29.4 |
| Hy_ave [atom %] | 14.3 | 24.0 | 33.7 |
| Hy_ave − Hx_ave [% age point] | 3.9 | 3.7 | 4.2 |
| Maximum value of \|Hx_ave − Hx\| [% age point] | 1.7 | 1.9 | 1.0 |
| Maximum value of Hx [atom %] | 12.1 | 21.9 | 30.4 |
| Minimum value of Hy [atom %] | 12.4 | 22.1 | 32.5 |

TABLE 6-continued

| | | Example 2 | Example 3 | Example 4 |
|---|---|---|---|---|
| Content of hydrogen atoms in end area [atom %] | Small area No. 1 | 15.8 | 25.6 | 33.4 |
| | Small area No. 2 | 16.3 | 24.6 | 34.6 |
| | Small area No. 3 | 15.7 | 23.5 | 33.5 |
| | Small area No. 4 | 14.3 | 22.6 | 34.3 |
| | Small area No. 5 | 12.4 | 22.4 | 32.5 |
| | Small area No. 6 | 12.6 | 22.1 | 32.6 |
| | Small area No. 7 | 12.7 | 22.9 | 33.4 |
| | Small area No. 8 | 13.6 | 24.3 | 32.7 |
| | Small area No. 9 | 15.1 | 25.9 | 34.2 |
| | Small area No. 10 | 14.8 | 26.4 | 35.4 |
| Content of hydrogen atoms in central portion area [atom %] | Small area No. 11 | 9.7 | 21.9 | 29.4 |
| | Small area No. 12 | 9.2 | 19.5 | 30.4 |
| | Small area No. 13 | 10.2 | 18.4 | 29.7 |
| | Small area No. 14 | 11.7 | 19.7 | 29.4 |
| | Small area No. 15 | 12.1 | 20.4 | 28.6 |
| | Small area No. 16 | 9.3 | 20.8 | 28.8 |
| | Small area No. 17 | 10.8 | 21.7 | 29.7 |

Each of the electrophotographic photosensitive members produced in Examples 2 to 4 was used, one at a time, to carry out evaluations for the end deformation of the electrophotographic photosensitive member, the image density non-uniformity, and the film peel-off at the ends of the electrophotographic photosensitive member, as is the case with Example 1. Table 7 shows the results of the evaluation.

TABLE 7

| | End deformation amount | Image density non-uniformity | End film peel-off |
|---|---|---|---|
| Example 2 | 0.82 | A | A |
| Example 3 | 0.71 | A | A |
| Example 4 | 0.57 | A | A |

In Examples 2 to 4, the end deformation of the electrophotographic photosensitive member and the image density non-uniformity were suppressed as is the case with Example 1.

The results of the evaluations indicate as follows. In an electrophotographic photosensitive member in which the average value Hy_ave [atom %] of the content of the hydrogen atoms in the end area is greater than the average value Hx_ave [atom %] of the content of the hydrogen atoms in the central portion area, when the average value Hx_ave [atom %] of the content of the hydrogen atoms in the central portion area is adjusted such that $10 \leq Hx_ave \leq 30$, the end deformation of the electrophotographic photosensitive member and the image density non-uniformity were suppressed.

Example 5 and Comparative Example 3

An electrophotographic photosensitive member in Example 5 was produced such that the maximum value of the |Hx_ave−Hx| was at most 5 percentage points. An electrophotographic photosensitive member in Comparative Example 3 was produced such that the maximum value of the |Hx_ave−Hx| was greater than 5 percentage points. Furthermore, at this time, the electrophotographic photosensitive members were produced such that the average value Hy_ave [atom %] of the content of the hydrogen atoms in the end area was greater than the Hx_ave [atom %] as is the case with Example 1.

In Example 5 and Comparative Example 3, the cylindrical-substrate heaters 3113 in FIG. 3 were adjusted such that the heater set temperature for the central portion area was higher than that for the end area as is the case with Example 1. In Example 5, the positions of the gas entries 3115 in the central portion area were adjusted such that the maximum value of the |Hx_ave−Hx| was at most 5 percentage points. In Comparative Example 3, the positions of the gas entries 3115 in the central portion area were adjusted such that the maximum value of the |Hx_ave−Hx| was greater than 5 percentage points.

For the film formation conditions (layer formation conditions) in Example 5 and Comparative Example 3, the electrophotographic photosensitive members were produced with the same conditions as those in Example 1 applied to the charge injection blocking layer and the surface layer and with conditions shown in Table 8 applied to the photoconductive layer.

As is the case described above, two electrophotographic photosensitive members were produced in each of Example 5 and Comparative Example 3.

TABLE 8

| | Example 5 | Comparative Example 3 |
|---|---|---|
| Type and flow rate of gas | | |
| $SiH_4$ [ml/min] [normal] | 90 | 60 |
| $H_2$ [ml/min] [normal] | 1000 | 800 |
| $B_2H_6$ [ppm vs. $SiH_4$] | 0.7 | 0.7 |
| NO [ml/min] [normal] | — | — |
| $CH_4$ [ml/min] [normal] | — | — |
| Heater set temperature for central portion area [° C.] | 350 | 370 |
| Heater set temperature for end area [° C.] | 330 | 350 |
| Pressure in reaction container [Pa] | 70 | 70 |
| High-frequency power [W] | 400 | 450 |
| Layer thickness [μm] | 30 | 30 |

Analysis was carried out using one of the two electrophotographic photosensitive members produced in each of Example 5 and Comparative Example 3.

TABLE 9

| | | Example 5 | Comparative Example 3 |
|---|---|---|---|
| | Hx_ave [atom %] | 19.6 | 15.8 |
| | Hy_ave [atom %] | 26.0 | 22.3 |
| | Hy_ave − Hx_ave [% age point] | 6.4 | 6.5 |
| | Maximum value of |Hx_ave − Hx| [% age point] | 5.0 | 6.5 |
| | Maximum value of Hx [atom %] | 23.5 | 19.8 |
| | Minimum value of Hy [atom %] | 24.4 | 20.8 |
| Content of hydrogen atoms in end area [atom %] | Small area No. 1 | 27.4 | 22.3 |
| | Small area No. 2 | 26.8 | 23.4 |
| | Small area No. 3 | 25.1 | 22.2 |
| | Small area No. 4 | 25.4 | 21.1 |
| | Small area No. 5 | 24.7 | 21.6 |
| | Small area No. 6 | 24.4 | 20.8 |
| | Small area No. 7 | 26.1 | 21.5 |
| | Small area No. 8 | 25.9 | 22.8 |
| | Small area No. 9 | 27.6 | 23.6 |
| | Small area No. 10 | 26.5 | 23.4 |
| Content of hydrogen atoms in central portion area [atom %] | Small area No. 11 | 23.5 | 19.8 |
| | Small area No. 12 | 19.8 | 17.5 |
| | Small area No. 13 | 17.3 | 13.4 |
| | Small area No. 14 | 14.6 | 9.3 |
| | Small area No. 15 | 18.1 | 14.1 |
| | Small area No. 16 | 20.7 | 17.3 |
| | Small area No. 17 | 22.9 | 19.2 |

Each of the electrophotographic photosensitive members produced in Example 5 and Comparative Example 3 was used to carry out evaluations for the end deformation of the electrophotographic photosensitive member, the image density non-uniformity, and the film peel-off at the ends of the electrophotographic photosensitive member, as is the case with Example 1. Table 10 shows the results of the evaluation.

TABLE 10

| | End deformation amount | Image density non-uniformity | End film peel-off |
|---|---|---|---|
| Example 5 | 0.64 | B | A |
| Comparative Example 3 | 0.78 | C | A |

In both Embodiment 5 and Comparative Example 3, the end deformation of the electrophotographic photosensitive member is suppressed as is the case with Example 1. In Example 5, the image density non-uniformity is also suppressed. However, in Comparative Example 3, the maximum value of the |Hx_ave−Hx| is greater than 5 percentage points, and in spite of the end deformation of the electrophotographic photosensitive member suppressed, the image density non-uniformity is not sufficiently restrained. This is expected to be because when the maximum value of the |Hx_ave−Hx| is greater than 5 percentage points, the |Hx_ave−Hx| itself significantly enhances the image density non-uniformity, which thus cannot be sufficiently suppressed.

The results of the evaluations indicate that the maximum value of the |Hx_ave−Hx| needs to be at most 5 percentage points in order to suppress the image density non-uniformity.

Examples 6 to 8 and Comparative Example 4

In Examples 6 to 8 and Comparative Example 4, electrophotographic photosensitive members were produced with the Hy_ave−Hx_ave set to about 12 atom % (Example 6), to about 7 atom % (Example 7), to about 2 atom % (Example 8), and to about 14 atom % (Comparative Example 4).

In Examples 6 to 8 and Comparative Example 4, the cylindrical-substrate heaters 3113 in FIG. 3 were adjusted such that the heater set temperature for the central portion area was higher than that for the end area.

Furthermore, the positions of the gas entries 3115 in FIG. 3 were adjusted in conjunction with the adjustment of the amount of the material gas. Specifically, a greater number of the gas entries 3115 were provided in the end area, in which a greater number of hydrogen atoms needed to be contained.

For the film formation conditions (layer formation conditions) in Examples 6 to 8 and Comparative Example 4, the electrophotographic photosensitive members were produced with the same conditions as those in Example 1 applied to the charge injection blocking layer and the surface layer and with conditions shown in Table 11 applied to the photoconductive layer.

As is the case described above, two electrophotographic photosensitive members were produced in each of Examples 6 to 8 and Comparative Example 4.

TABLE 11

| | Example 6 | Example 7 | Example 8 | Comparative Example 4 |
|---|---|---|---|---|
| Type and flow rate of gas | | | | |
| $SiH_4$ [ml/min] [normal] | 35 | 90 | 90 | 35 |
| $H_2$ [ml/min] [normal] | 700 | 1000 | 1000 | 700 |
| $B_2H_6$ [ppm vs. $SiH_4$] | 0.7 | 0.7 | 0.7 | 0.7 |
| NO [ml/min] [normal] | — | — | — | — |

TABLE 11-continued

| | Example 6 | Example 7 | Example 8 | Comparative Example 4 |
|---|---|---|---|---|
| $CH_4$ [ml/min] [normal] | — | — | — | — |
| Heater set temperature for central portion area [° C.] | 400 | 350 | 350 | 400 |
| Heater set temperature for end area [° C.] | 380 | 330 | 330 | 380 |
| Pressure in reaction container [Pa] | 70 | 70 | 70 | 70 |
| High-frequency power [W] | 450 | 400 | 400 | 450 |
| Layer thickness [μm] | 30 | 30 | 30 | 30 |

Analysis was carried out in the same manner as that in Example 1 using each of the electrophotographic photosensitive members produced in Examples 6 to 8 and Comparative Example 4. Table 12 shows the results of the analysis.

TABLE 12

| | | Example 6 | Example 7 | Example 8 | Comparative Example 4 |
|---|---|---|---|---|---|
| | Hx_ave [atom %] | 10.1 | 20.1 | 20.0 | 10.2 |
| | Hy_ave [atom %] | 22.0 | 26.9 | 22.1 | 24.1 |
| | Hy_ave − Hx_ave [% age point] | 11.9 | 6.8 | 2.0 | 13.8 |
| | Maximum value of \|Hx_ave − Hx\| [% age point] | 1.2 | 1.4 | 0.9 | 1.3 |
| | Maximum value of Hx [atom %] | 11.3 | 21.5 | 20.7 | 11.5 |
| | Minimum value of Hy [atom %] | 13.4 | 23.1 | 21.3 | 16.5 |
| Content of hydrogen atoms in end area [atom %] | Small area No. 1 | 27.6 | 29.7 | 22.8 | 29.1 |
| | Small area No. 2 | 26.4 | 28.4 | 22.7 | 27.4 |
| | Small area No. 3 | 22.8 | 26.6 | 21.7 | 24.3 |
| | Small area No. 4 | 18.6 | 25.3 | 21.5 | 21.4 |
| | Small area No. 5 | 13.4 | 23.1 | 21.3 | 16.5 |
| | Small area No. 6 | 14.1 | 23.7 | 21.4 | 16.8 |
| | Small area No. 7 | 19.2 | 26.2 | 21.6 | 22.8 |
| | Small area No. 8 | 23.1 | 27.4 | 22.5 | 24.5 |
| | Small area No. 9 | 27.5 | 28.3 | 22.8 | 28.1 |
| | Small area No. 10 | 27.7 | 29.8 | 22.4 | 29.6 |
| Content of hydrogen atoms in central portion area [atom %] | Small area No. 11 | 10.4 | 20.4 | 19.1 | 11.5 |
| | Small area No. 12 | 9.6 | 18.7 | 19.9 | 10.1 |
| | Small area No. 13 | 9.3 | 20.8 | 20.5 | 9.4 |
| | Small area No. 14 | 10.7 | 19.5 | 20.7 | 9.4 |
| | Small area No. 15 | 11.3 | 19.1 | 20.2 | 9.2 |
| | Small area No. 16 | 9.2 | 20.6 | 19.9 | 10.6 |
| | Small area No. 17 | 10.2 | 21.5 | 19.9 | 11.3 |

Each of the electrophotographic photosensitive members produced in Examples 6 to 8 and Comparative Example 4 was used to carry out evaluations for the end deformation of the electrophotographic photosensitive member, the image density non-uniformity, and the film peel-off at the ends of the electrophotographic photosensitive member, as is the case with Example 1. Table 13 shows the results of the evaluation.

TABLE 13

| | End deformation amount | Image density non-uniformity | End film peel-off |
|---|---|---|---|
| Example 6 | 0.77 | B | B |
| Example 7 | 0.69 | A | A |
| Example 8 | 0.91 | A | A |
| Comparative Example 4 | 1.22 | C | C |

In Examples 6 to 8, the end deformation of the electrophotographic photosensitive member and the image density non-uniformity are suppressed as is the case with Example 1.

However, in Comparative Example 4, the ends of the electrophotographic photosensitive member are significantly deformed, thus increasing the likelihood of film peel-off at the ends of the electrophotographic photosensitive member.

The results of the evaluations indicate that setting the value Hy_ave−Hx_ave to at least 2 percentage points and at most 12 percentage points is required to suppress the end deformation of the electrophotographic photosensitive member and the image density non-uniformity.

Examples 9 and 10

In each of Examples 9 and 10, an electrophotographic photosensitive member having two-layered photoconductive layers as illustrated in FIG. 2 was produced.

At this time, the electrophotographic photosensitive members with the two-layered photoconductive layers in Examples 9 and 10 were produced such that in regard to the contents of hydrogen atoms in a first layer (charge injection blocking layer side) and a second layer (surface layer side) in a layer thickness direction, the content of the hydrogen atoms in the end area of the photoconductive layer was greater than the content of the hydrogen atoms in the central portion area as is the case with Example 1. Furthermore, in Example 9, the content of the hydrogen atoms in the first layer was set higher than the content of the hydrogen atoms in the second layer. Additionally, in Example 10, contrary to Example 9, the content of the hydrogen atoms in the first layer was set lower than the content of the hydrogen atoms in the second layer.

In Examples 9 and 10, the cylindrical-substrate heaters 3113 in FIG. 3 were adjusted such that the heater set temperature for the central portion area was higher than that for the end area. Furthermore, the contents of the hydrogen atoms in the first layer and the second layer were adjusted based on the material gas and the substrate temperature.

Furthermore, the positions of the gas entries 3115 in FIG. 3 were adjusted in conjunction with the adjustment of the amount of the material gas. Specifically, a greater number of the gas entries 3115 were provided in the end area, in which a greater number of hydrogen atoms needed to be contained.

For the film formation conditions (layer formation conditions) in Examples 9 to 10, the electrophotographic photosensitive members were produced with the same conditions as those in Example 1 applied to the charge injection blocking layer and the surface layer and with conditions shown in Table 14 applied to the photoconductive layer.

As is the case described above, two electrophotographic photosensitive members were produced in each of Examples 9 to 10.

TABLE 14

| | Example 9 | | Example 10 | |
|---|---|---|---|---|
| | First layer | Second layer | First layer | Second layer |
| Type and flow rate of gas | | | | |
| $SiH_4$ [ml/min] [normal] | 150 | 120 | 120 | 150 |
| $H_2$ [ml/min] [normal] | 800 | 800 | 800 | 800 |
| $B_2H_6$ [ppm vs. $SiH_4$] | 0.7 | — | 0.7 | — |
| NO [ml/min] [normal] | — | — | — | — |
| $CH_4$ [ml/min] [normal] | — | — | — | — |
| Heater set temperature for central portion area [° C.] | 320 | 340 | 340 | 320 |

TABLE 14-continued

| | Example 9 | | Example 10 | |
|---|---|---|---|---|
| | First layer | Second layer | First layer | Second layer |
| Heater set temperature for end area [° C.] | 310 | 330 | 330 | 310 |
| Pressure in reaction container [Pa] | 70 | 70 | 70 | 70 |
| High-frequency power [W] | 400 | 400 | 400 | 400 |
| Layer thickness [μm] | 20 | 10 | 20 | 10 |

Analysis was carried out in the same manner as that in Example 1 using each of the electrophotographic photosensitive members produced in Examples 9 and 10. At this time, the content of hydrogen atoms was calculated for the small areas in the first and second layers of the photoconductive layer. Each of the values for the first and second layers is regarded as a value for a central portion of the corresponding layer in the layer thickness direction in a cross section. Table 15 shows the results of the analysis.

TABLE 15

| | | Example 9 | | Example 10 | |
|---|---|---|---|---|---|
| | | First layer | Second layer | First layer | Second layer |
| | Hx_ave [atom %] | 24.1 | | 22.7 | |
| | Hy_ave [atom %] | 27.1 | | 26.2 | |
| | Hy_ave − Hx_ave [% age point] | 3.0 | | 3.5 | |
| | Maximum value of Hx [atom %] | 26.3 | 23.1 | 23.3 | 25.7 |
| | Minimum value of Hy [atom %] | 26.5 | 23.5 | 23.6 | 26.2 |
| Content of hydrogen atoms in end area [atom %] | Small area No. 1 | 28.8 | 26.3 | 26.6 | 29.5 |
| | Small area No. 2 | 29.4 | 25.8 | 26.4 | 29.1 |
| | Small area No. 3 | 281 | 25.4 | 25.3 | 28.6 |
| | Small area No. 4 | 27.3 | 24.4 | 24.1 | 27.3 |
| | Small area No. 5 | 26.5 | 23.7 | 23.6 | 26.2 |
| | Small area No. 6 | 26.7 | 23.5 | 23.9 | 26.6 |
| | Small area No. 7 | 27.5 | 24.7 | 24.5 | 27.6 |
| | Small area No. 8 | 28.6 | 25.6 | 25.9 | 27.9 |
| | Small area No. 9 | 28.9 | 26.2 | 26.7 | 28.7 |
| | Small area No. 10 | 29.1 | 25.4 | 26.2 | 29.6 |
| Content of hydrogen atoms in central portion area [atom %] | Small area No. 11 | 25.9 | 23.1 | 22.9 | 25.7 |
| | Small area No. 12 | 26.1 | 22.2 | 23.3 | 25.3 |
| | Small area No. 13 | 24.3 | 21.2 | 21.4 | 24.2 |
| | Small area No. 14 | 23.4 | 19.8 | 20.5 | 23.6 |
| | Small area No. 15 | 24.8 | 21.4 | 19.6 | 24.4 |
| | Small area No. 16 | 25.4 | 22.4 | 21.7 | 24.9 |
| | Small area No. 17 | 26.3 | 23.1 | 22.8 | 25.5 |

Each of the electrophotographic photosensitive members produced in Examples 9 to 10 was used to carry out evaluations for the end deformation of the electrophotographic photosensitive member, the image density non-uniformity, and the film peel-off at the ends of the electrophotographic photosensitive member, as is the case with Example 1. Table 16 shows the results of the evaluation.

TABLE 16

| | End deformation amount | Image density non-uniformity | End film peel-off |
|---|---|---|---|
| Example 9 | 0.63 | A | A |
| Example 10 | 0.68 | A | A |

The results of the evaluations indicate that even when the photoconductive layer is formed of two layers as is the case with Examples 9 and 10, the end deformation of the electrophotographic photosensitive member and the image density non-uniformity are suppressed by setting the average contents Hy_ave [atom %] and Hx_ave [atom %] of the hydrogen atoms in the first and second layers of the photoconductive layer in the layer thickness direction so that the Hy_ave [atom %] is greater than the Hx_ave [atom %].

The results of the evaluation also indicate that when the photoconductive layer is formed of two layers, the effect of suppressing the end deformation of the electrophotographic photosensitive member and the image density non-uniformity is exerted regardless of whichever of the content of the hydrogen atoms in the first layer and the content of the hydrogen atoms in the second layer is higher.

Example 11

In Example 11, electrophotographic photosensitive members were produced such that in each of the opposite end areas divided into five small areas, the content of hydrogen atoms increased progressively toward the end. That is, the electrophotographic photosensitive members were produced such that the content of hydrogen atoms increased progressively from small area No. 5 to small area No. 1 and from small area No. 6 to small area No. 10 in the end area illustrated in FIG. 4.

In Example 11, the cylindrical-substrate heaters 3113 in FIG. 3 were adjusted such that the heater set temperature for the central portion area was higher than that for the end area.

Furthermore, the positions of the gas entries 3115 in FIG. 3 were adjusted such that the content of the hydrogen atoms in the end area increased progressively toward the end.

For the film formation conditions (layer formation conditions) in Example 11, the electrophotographic photosensitive members were produced with the same conditions as those in Example 1 applied to the charge injection blocking layer, the photoconductive layer, and the surface layer.

As is the case described above, two electrophotographic photosensitive members were produced in Example 11.

Analysis was carried out in the same manner as that in Example 1 using one of the electrophotographic photosensitive members produced in Example 11. Table 17 shows the results of the analysis.

TABLE 17

| | | Example 11 |
|---|---|---|
| | Hx_ave [atom %] | 25.0 |
| | Hy_ave [atom %] | 28.7 |
| | Hy_ave − Hx_ave [% age point] | 3.7 |
| | Maximum value of \|Hx_ave − Hx\| [% age point] | 1.7 |
| | Maximum value of Hx [atom %] | 26.3 |
| | Minimum value of Hy [atom %] | 26.6 |
| Content of hydrogen atoms in end area [atom %] | Small area No. 1 | 31.2 |
| | Small area No. 2 | 29.7 |
| | Small area No. 3 | 28.7 |
| | Small area No. 4 | 27.5 |
| | Small area No. 5 | 26.6 |
| | Small area No. 6 | 26.9 |
| | Small area No. 7 | 27.4 |
| | Small area No. 8 | 28.8 |
| | Small area No. 9 | 29.5 |
| | Small area No. 10 | 30.7 |
| Content of hydrogen atoms in central portion area [atom %] | Small area No. 11 | 26.1 |
| | Small area No. 12 | 25.5 |
| | Small area No. 13 | 24.7 |
| | Small area No. 14 | 23.3 |
| | Small area No. 15 | 24.1 |
| | Small area No. 16 | 25.3 |
| | Small area No. 17 | 26.3 |

Each of the electrophotographic photosensitive members produced in Example 11 was used to carry out evaluations for the end deformation of the electrophotographic photosensitive member, the image density non-uniformity, and the film peel-off at the ends of the electrophotographic photosensitive member, as is the case with Example 1. Table 18 shows the results of the evaluation.

TABLE 18

| | End deformation amount | Image density non-uniformity | End film peel-off |
|---|---|---|---|
| Example 11 | 0.53 | A | A |

The results of the evaluations indicate that when the content of the hydrogen atoms in the end area increases progressively toward the end as is the case with Example 11, the effect of suppressing the end deformation of the electrophotographic photosensitive member is further improved.

This is expected to be because when the progressive increase in the content of the hydrogen atoms toward the end allows stress otherwise concentrated at the end of the substrate to be more efficiently relaxed, further suppressing the end deformation of the electrophotographic photosensitive member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-146813, filed Jun. 28, 2010, and Japanese Patent Application No. 2011-134187, filed Jun. 16, 2011, which are hereby incorporated by reference herein in their entirety.

What is claimed is:

1. An electrophotographic photosensitive member comprising a cylindrical substrate and a photoconductive layer provided on the cylindrical substrate and formed of amorphous silicon containing hydrogen atoms, wherein when an average value of a content ratio of the hydrogen atoms to a sum of silicon atoms and the hydrogen atoms in a central portion area of the photoconductive layer in a cylindrically axial direction thereof is denoted by Hx_ave [atom %], a content ratio of the hydrogen atoms to the sum of the silicon atoms and the hydrogen atoms at an arbitrary point in the central portion area is denoted by Hx [atom %], an average value of a content ratio of the hydrogen atoms to the sum of the silicon atoms and the hydrogen atoms in an end area of the photoconductive layer in the cylindrically axial direction thereof is denoted by Hy_ave [atom %], and a content ratio of the hydrogen atoms to the sum of the silicon atoms and the hydrogen atoms at an arbitrary point in the end area is denoted by Hy [atom %], and wherein the Hx_ave, Hx, Hy_ave and Hy satisfy Expressions 1 to 4:

$$10 \leq Hx_ave \leq 30 \quad \text{(Expression 1)}$$

$$Hx < Hy \quad \text{(Expression 2)}$$

$$|Hx_ave - Hx| \leq 5 \quad \text{(Expression 3)}$$

$$2 \leq Hy_ave - Hx_ave \leq 12 \quad \text{(Expression 4).}$$

2. The electrophotographic photosensitive member according to claim 1, wherein the content ratio of the hydrogen atoms with respect to the sum of the silicon atoms and the hydrogen atoms in the end area of the photoconductive layer in the cylindrically axial direction thereof increases progressively toward an end of the photoconductive layer in the cylindrically axial direction thereof.

3. An electrophotographic apparatus comprising the electrophotographic photosensitive member according to claim 1, a charging device, an imagewise exposure device, a developing device, and a transfer device.

* * * * *